US007182218B2

(12) United States Patent
Raines

(10) Patent No.: US 7,182,218 B2
(45) Date of Patent: Feb. 27, 2007

(54) PILL DISPENSER

(75) Inventor: Michael Raines, Santa Monica, CA (US)

(73) Assignee: Sammylife, Inc., Los Angeles, CA (US)

( * ) Notice: Subject to any disclaimer, the term of this patent is extended or adjusted under 35 U.S.C. 154(b) by 45 days.

(21) Appl. No.: 10/933,824

(22) Filed: Sep. 2, 2004

(65) Prior Publication Data

US 2005/0178786 A1 Aug. 18, 2005

Related U.S. Application Data

(60) Provisional application No. 60/500,036, filed on Sep. 4, 2003.

(51) Int. Cl.
*B65H 3/44* (2006.01)

(52) U.S. Cl. ..... 221/123; 221/114; 221/101

(58) Field of Classification Search ..... 221/75, 221/89, 91, 101, 114, 2; 206/538, 534; 368/10, 368/107, 108, 109
See application file for complete search history.

(56) References Cited

U.S. PATENT DOCUMENTS 4,062,445 A * 12/1977 Moe ..... 206/1.5
4,126,247 A * 11/1978 Majka ..... 221/91
5,159,581 A * 10/1992 Agans ..... 221/9

* cited by examiner

*Primary Examiner*—Gene O. Crawford
*Assistant Examiner*—Timothy Waggoner
(74) *Attorney, Agent, or Firm*—Thelen Reid Brown Raysman & Steiner LLP

(57) ABSTRACT

The present invention is a pill dispenser and organizer to provide easy access and clear organization of various pills to be consumed daily. The dispenser can hold pills in 12 compartments (4 rows of 3 columns each) or 28 compartments (4 rows of 7 columns each). In operation, a user drops pills from the top of the dispenser into the columns of the topmost row. Various embodiments of a mechanism on the side of each row (except the bottommost row) allows the user to transfer the pills from a column in a higher row to a column in a lower row. A set of mechanisms allow the user to remove the pills from the bottommost row, one column at a time. The present invention can be rectangular (the compartments lined in rows and columns) or circular in shape (the compartments extending radially from the center).

13 Claims, 10 Drawing Sheets

PILL DISPENSER

CROSS-REFERENCE TO RELATED APPLICATION(S)

The present application claims the benefit of priority from pending U.S. Provisional Patent Application No. 60/500,036, entitled "Pill Dispenser", filed on Sep. 4, 2003, which is herein incorporated by reference in its entirety.

BACKGROUND OF THE INVENTION

1. Field of the Invention

The present invention is in the field of pill dispenser and organizer.

2. Background Art

Portions of the disclosure of this patent document may contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

Many people rely on organizers and dispensers to keep track of medication that have to be taken regularly. Organizers help users remember what pills to take and when. In some cases, medication is put into compartments by someone other that the person consuming the medication. The person consuming the medication may be relying on the dispensers to keep up a medication regimen. Ease of access and clear organization are some important features in pill organizers and dispensers.

SUMMARY OF THE INVENTION

The present invention is a pill dispenser and organizer. The dispenser and organizer embodiments of the present invention provide easy access to pills and clear organization for the different pills to be consumed daily. According to one embodiment, the dispenser is rectangle shaped organized in 12 compartments (4 rows of 3 compartments each). This is the travel size embodiment of the present invention. According to another embodiment, the dispenser is rectangle shaped organized in 28 compartments (4 rows of 7 compartments each). According to another embodiment, the dispenser is circular shaped organized into compartments that extend radially from the center.

In the rectangular shaped embodiment of the organizer, there is a lid which has to be open by a user to deposit pills or other contents into each column of the topmost row. According to another embodiment, there is a mechanism at each row of the dispenser (except the bottommost row) that allows the user to transfer the contents of each column of a row into a corresponding column in a lower row. According to another embodiment, the transfer is further aided by a slanted section within each column that slides the contents entering the top of each column to the bottom. According to another embodiment, the mechanism at each row has various operating modes. According to another embodiment, the bottommost row has a mechanism for each of its columns to assist the user to remove the contents of each column.

In the circular shaped embodiment of the organizer, there is a funnel shaped inlet at the top of the organizer via which a user can deposit pills or other contents into a compartment. According to another embodiment there is a trap door at the bottom of the organizer via which the pills or other contents can be removed by a user. According to another embodiment, the organizer has a rotating hub in the center with several holes that a user could use to rotate the organizer.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

The present invention is directed to a pill dispenser and organizer. In the following description, numerous specific details are set forth to provide a more thorough description of embodiments of the invention. It is apparent, however, to one skilled in the art, that the invention may be practiced without these specific details. In other instances, well known features have not been described in detail so as not to obscure the invention.

Travel Size Dispenser

Figure 1:
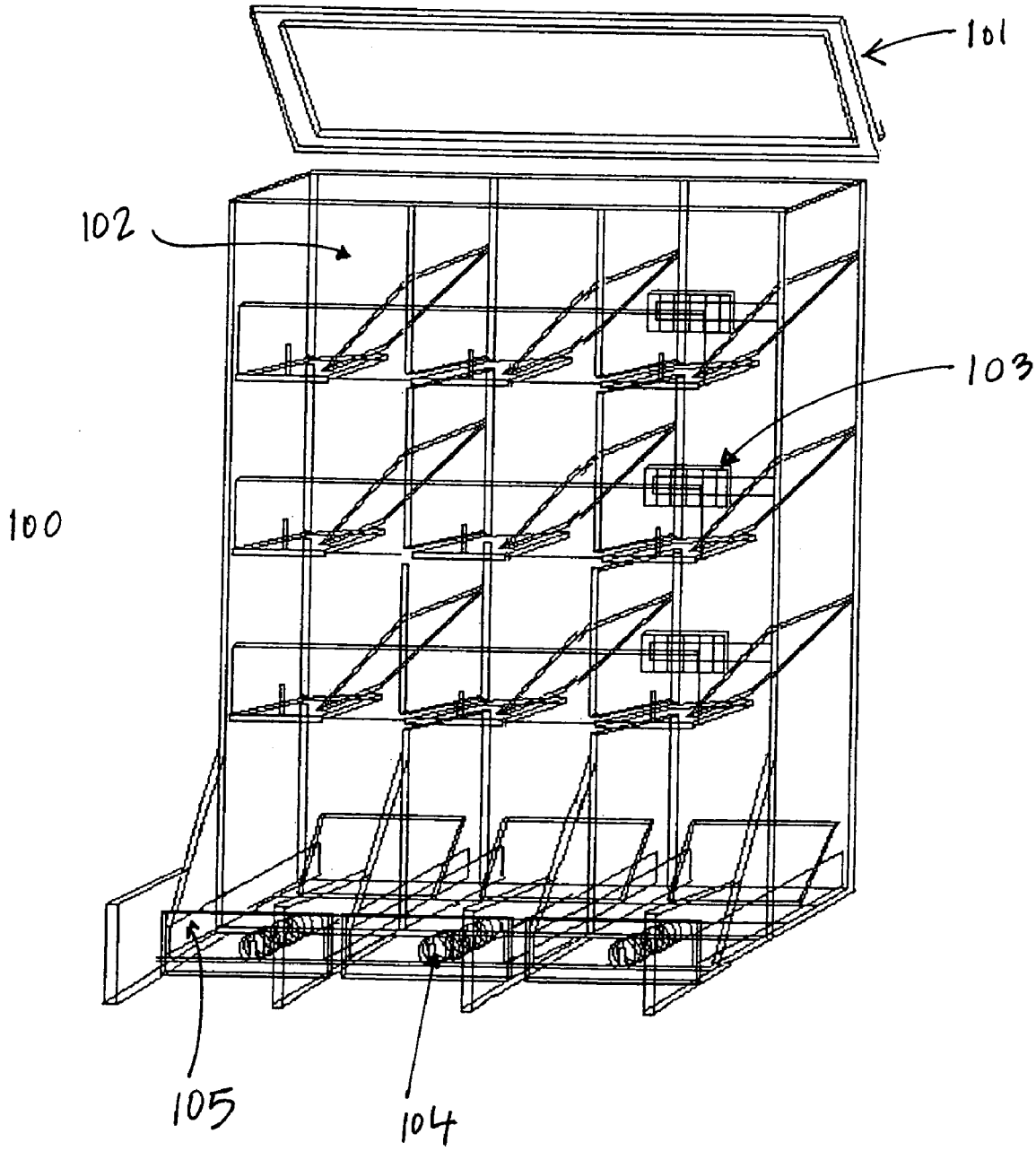
FIG. 1 shows one embodiment of the present invention.

FIG. 1 shows a pill dispenser 100 comprising of a trap door 101 and pill compartments 102. Pill compartments 102 are organized in a matrix of M columns wide and N rows high. According to the embodiment of FIG. 1, the pill dispenser is organized in 12 compartments—4 rows of 3 compartments each. This is the travel size embodiment of the present invention. Trap door 101 is located above the top row, allowing pills to be deposited into the top row compartments. Pill dispenser 100 is made of clear plastic or other see-through material allowing the user to see what pills or other contents are stored in each compartment.

Pill dispenser 100 also comprises of a slide button 103 located at the end of each row, except the bottom row, to facilitate transfer of pills from one row to the next. Sliding the slide button 103 to the right slides that row bottom releasing the pills in the current row to the row below. In the embodiment of FIG. 1, three slide buttons are provided for the top three rows. A row of door guards 105 are located in the bottom row of the pill dispenser. These door guards stop the contents of the bottommost row to spill out accidentally.

Another set of push buttons 104 are located in the bottom row of the pill dispenser. Each push button is used to release the pills stored in the corresponding pill compartments in the bottom row. In the embodiment of FIG. 1, there are three such push buttons provided for the three compartments in the bottom row.

Weekly Dispenser

Figure 2:
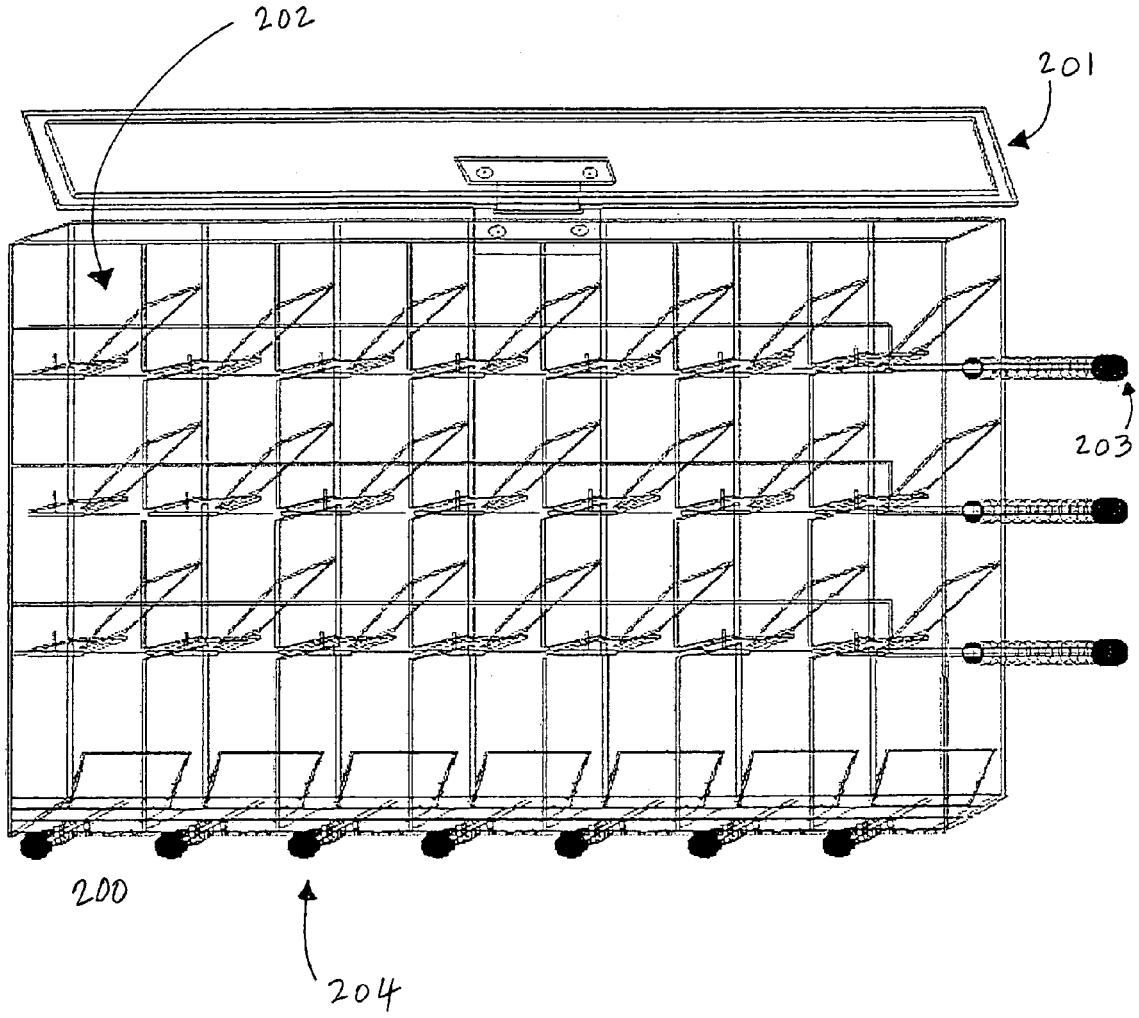
FIG. 2 shows another embodiment of the present invention.

FIG. 2 shows another embodiment of the present invention. Pill dispenser 200 comprises of a trap door 201 and pill compartments 202. Pill compartments 202 are organized in a matrix of M columns wide and N rows high. In the embodiment of FIG. 2, M is 7 and N is 4, allowing the pill dispenser to store 4 weeks supply of pills. Trap door 201 is located above the top row, allowing pills to be deposited into the top row compartments. Pill dispenser 200 is made of clear plastic or other see-through material, allowing the user to what pills are stored in each compartment.

A push button 203 is located at the end of each row of pill compartments to facilitate transfer of pills from one row to the next. Pushing push button 203 will release pills in the current row to the row below. In the embodiment of FIG. 2, three push buttons are provided for the top three rows.

Another set of push buttons 204 are located in the bottom row of the pill dispenser. Each push button is used to release the pills stored in the corresponding pill compartments in the bottom row. In the embodiment of FIG. 2, there are seven of such push buttons provided for the seven pill compartments in the bottom row.

Figure 3:
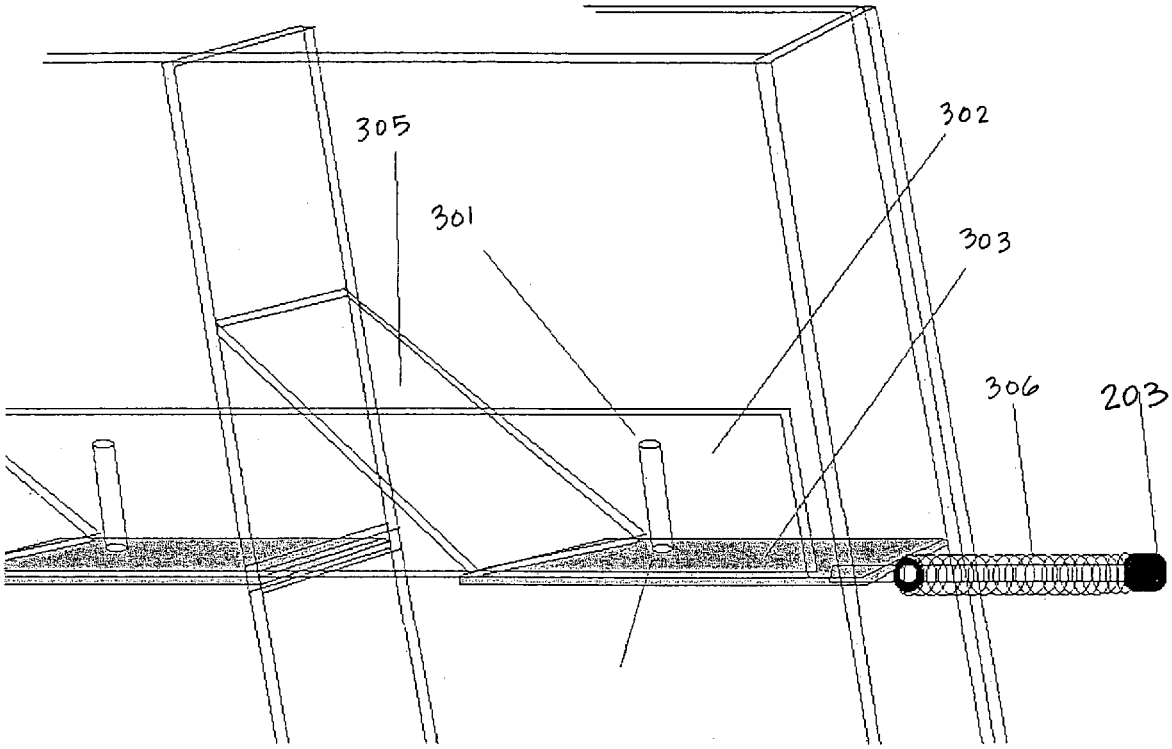
FIG. 3 is an enlarged view of a pill compartment that is not in the bottom row of the pill dispenser depicted in FIG. 2, according to one embodiment of the present invention.

FIG. 3 is an enlarged view of one of the pill compartments in the pill dispenser that is not in the bottommost row of the dispenser. The pill compartment comprises a pill rake 301, a portion of slide body 302, a bottom slide 303, and back slide 305. Pill rake 301 is used for moving pills such as gel caps that may be stuck inside the compartment. This pill compartment is located at the end of a row, which makes it adjacent to push button 203 and its associated spring 306. When pills are deposited into a pill compartment, they slide down back slide 305 and rest on bottom slide 303. The pill compartment as shown in FIG. 3 is in the "closed" position. When push button 203 is pushed, bottom slide 303 is moved toward back slide 305 so that any pill resting on bottom slide 303 will fall to the pill compartment below. This is the "open" position. All the bottom slides on the same row are connected by slide body 302 so that a push at push button 203 can move all the bottom slides in the row. Spring 306 is attached to push button 203 to ensure that all bottom slides 303 return to the "closed" position by default. Spring 306 also ensures that bottom slides 303 stay in the "closed" position and do not move accidentally into the "open" position. In the embodiment shown in FIG. 3, the spring 306 is located outside the body of the pill dispenser 100 (or 200).

Figure 4:
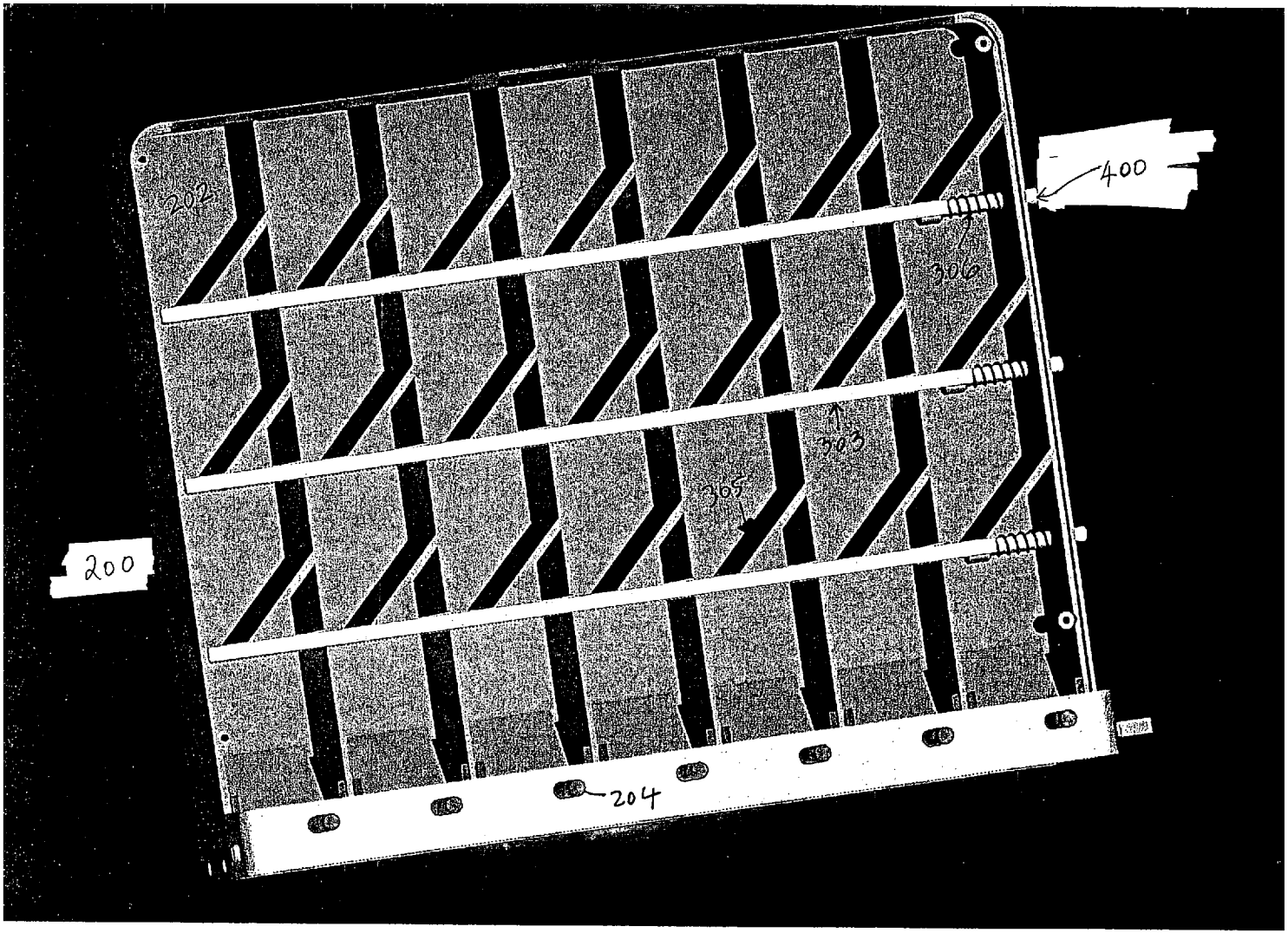
FIG. 4 shows another embodiment of the present invention.

FIG. 4 shows another embodiment of the present invention. Pill dispenser 200 comprises pill compartments 202. Pill compartments 202 are organized in a matrix of M columns wide and N rows high. In the embodiment of FIG. 4, M is 7 and N is 4, allowing the pill dispenser to store 4 weeks supply of pills. Pill dispenser 200 is made of clear plastic or other see-through material, allowing the user to what pills are stored in each compartment.

A pull button 400 is located at the end of each row of pill compartments to facilitate transfer of pills from one row to the next. Pulling button 400 will release pills in the current row to the row below. In the embodiment as shown, three pull buttons are provided for the top three rows. When pills are deposited into a pill compartment, they slide down back slide 305 and rest on bottom slide 303. The pill compartment as shown in FIG. 4 is in the "closed" position. When pull button 400 is pulled, bottom slide 303 is moved toward back slide 305 so that any pill resting on bottom slide 303 will fall to the pill compartment below. This is the "open" position. Spring 306 is attached to pull button 400 to ensure that all bottom slides 303 return to the "closed" position by default. Spring 306 also ensures that bottom slides 303 stay in the "closed" position and do not move accidentally into the "open" position. In the embodiment shown in FIG. 4, the spring 306 is located inside the body of the pill dispenser 200 (or 100).

A set of push buttons 204 are located in the bottom row of the pill dispenser. Each push button is used to release the pills stored in the corresponding pill compartments in the bottom row. In the embodiment of FIG. 4, there are seven of such push buttons provided for the seven pill compartments in the bottom row.

Figure 5:
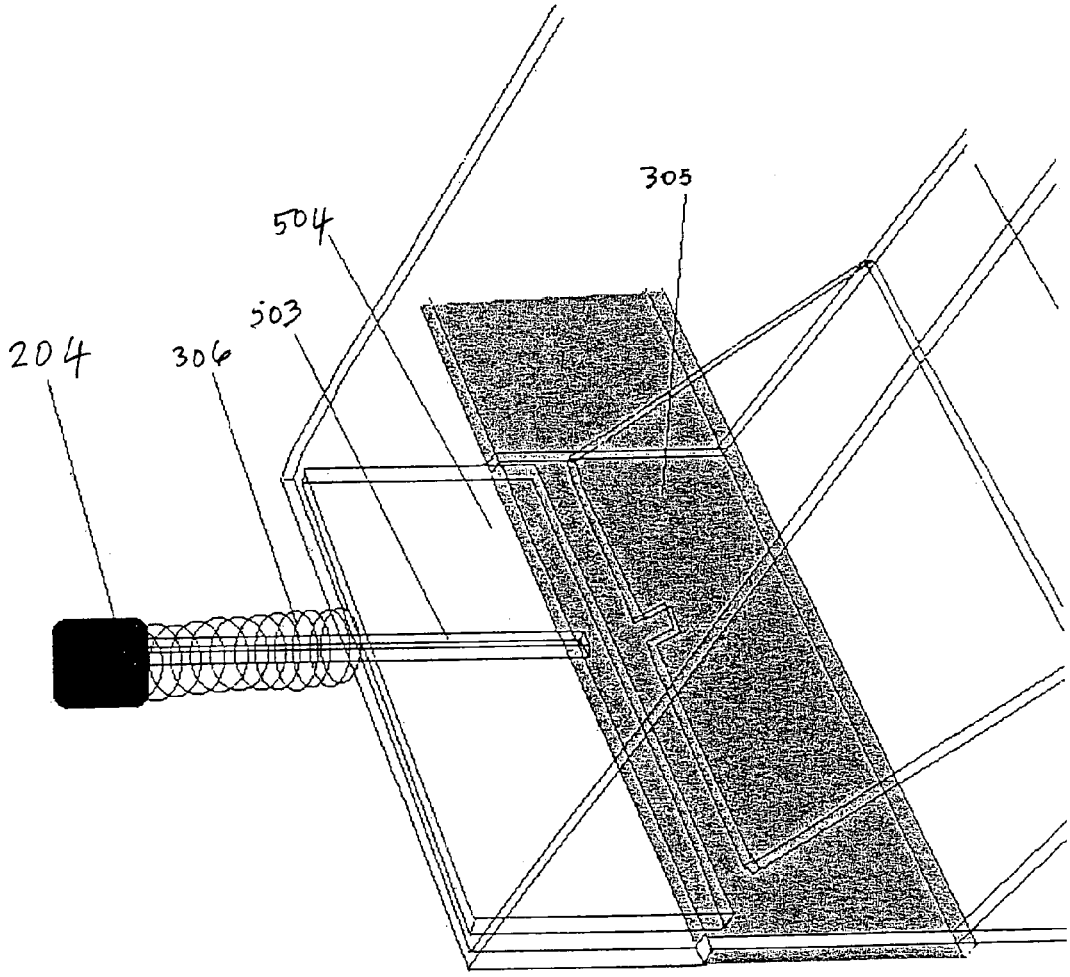
FIG. 5 is an enlarged view of a pill compartment that is in the bottom row of the pill dispenser depicted in FIG. 2, according to one embodiment of the present invention.

FIG. 5 is an enlarged view of a pill compartment in the bottom row of a pill dispenser. The pill compartment comprises a slide body 504, a back slide 305, a slide arm 503, a push button 204, and a spring 306. When pills are deposited into this pill compartment, they slide down back slide 305 and rest on slide body 504. As shown in FIG. 3, the pill compartment is in the "closed" position. When push button 204 is pushed, the slide arm 503 is moved inward so that slide body 504 is moved into the "open" position. In this position, any pill that was previously resting on slide body 504 falls out of the pill dispenser and can be collected for consumption. Spring 306 is attached to push button 204 to ensure that slide body 504 returns to the "closed" position. Spring 306 also ensures that slide body 504 stays in the "closed" position and does not move accidentally into the "open" position.

In operation, a user would insert pills into the pill compartments in the top row by opening trap door 101 (or 201). Then the user would press push buttons 203 (or pull buttons 400) on the side to release the pills so that they eventually fall to the bottommost row and rest there. Subsequently, the second to the bottom row can be filled. Then the second from the top row can be filled. Finally, the top row can be filled. Once all the pills in the bottommost row are consumed, the user can use push buttons 203 (or pull buttons 400) on the side to move all pills down one row. The top row now becomes empty and is ready for refill. Push buttons 203 (or pull buttons 400) provide an easy way to rotate the supply of pills. The pills in the bottommost are collected for consumption by a user by pressing push button 204, or by pressing push surface 804 (see below).

Figure 6:
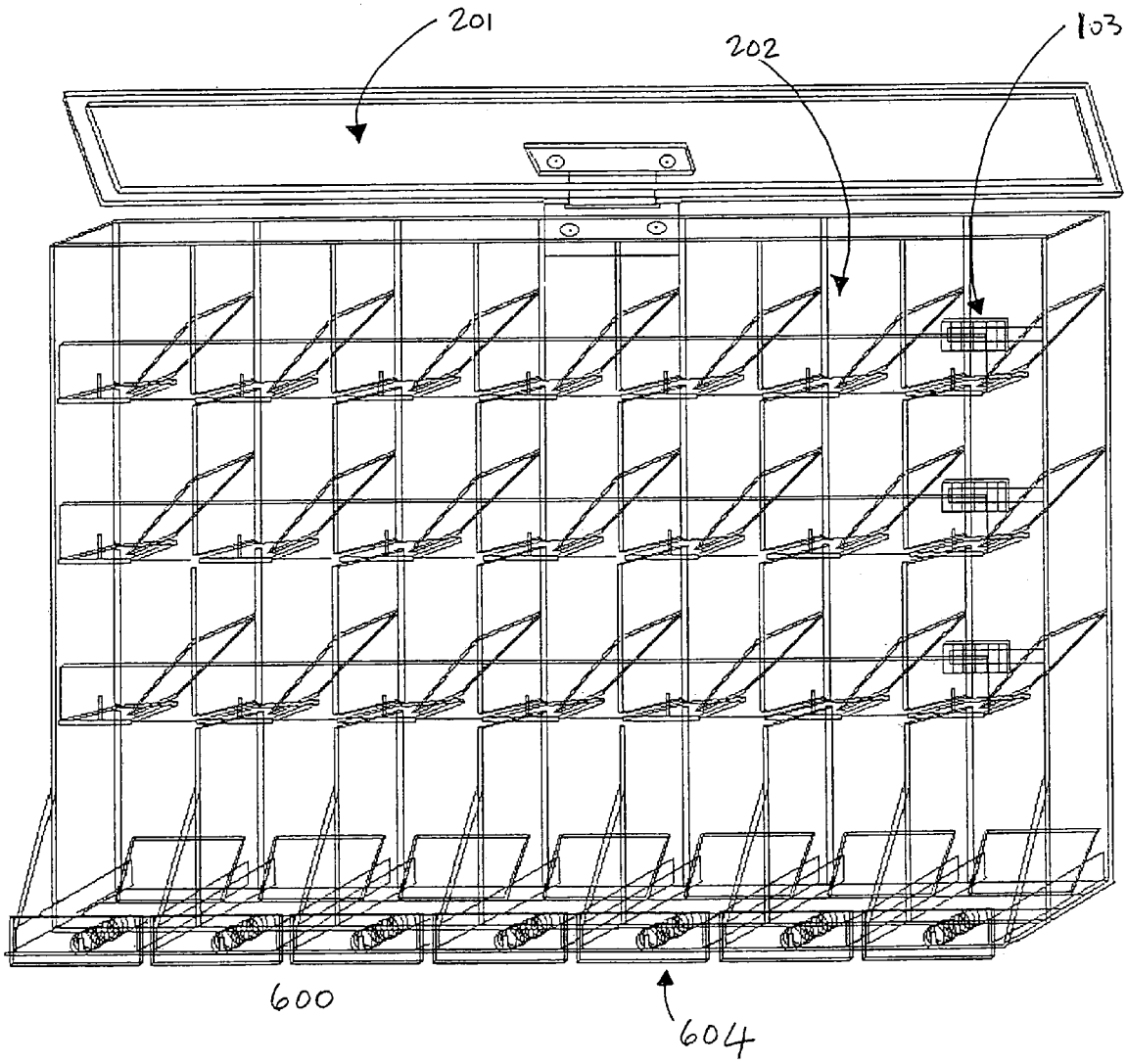
FIG. 6 shows another embodiment of the present invention.

FIG. 6 shows another embodiment of the present invention. Pill dispenser 600 also comprises of a trap door 201 and pill compartments 202. Pill compartments 202 are organized in a matrix of M columns wide and N rows high. In the embodiment of FIG. 6, M is 7 and N is 4, allowing the pill dispenser to store 4 weeks supply of pills. Trap door 201 is located on the top row, allowing pills to be deposited into the compartments on the top row. Pill dispenser 600 is made of clear plastic or other see-through material, allowing the user to what pills are stored in each compartment.

A slide button 103 is located at the pill compartment located at the end of each row, 3except the bottom row, to facilitate transfer of pills from one row to the next. Sliding the slide button 103 to the right slides that row bottom releasing the pills in the current row to the row below. In the embodiment as shown, three slide buttons are provided for the top three rows. A row of drawer compartments 604 are located in the bottom row of the pill dispenser. Each drawer compartment 604 is used to release the pills stored in the bottom row.

Figure 7:
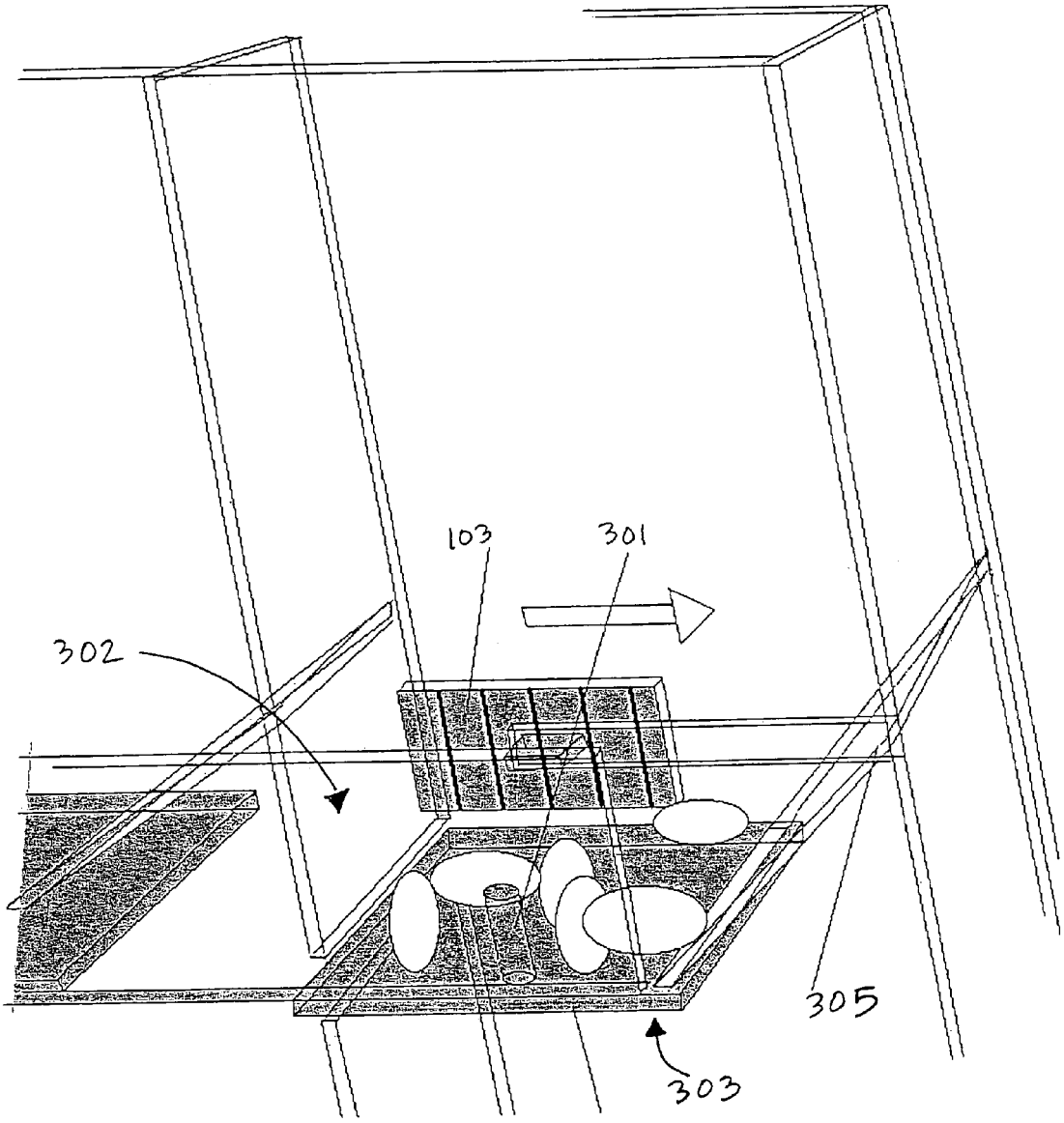
FIG. 7 is an enlarged view of a pill compartment that is not in the bottom row of the pill dispenser depicted in FIG. 6, according to one embodiment of the present invention.

FIG. 7 is an enlarged view of one of the pill compartments that are not in the bottom row of the pill dispenser shown in FIG. 6. The pill compartment comprises a slide button 103, a pill rake 301, portion of slide body 302, a bottom slide 303, and a back slide 305. Pill rake 301 is used for stirring pills that may be stuck inside the compartment. Slide 305 facilitates the falling pills (or other contents) from above to rest on bottom slide 303. The user can push slide button 103 in the direction indicated in the figure (see arrow) to move all bottom slides 303 in that row and make the pills stored in the row fall onto the row below. This is because all bottom slides 303 in a row are connected by slide body 302, which is moved by slide button 103.

Figure 8:
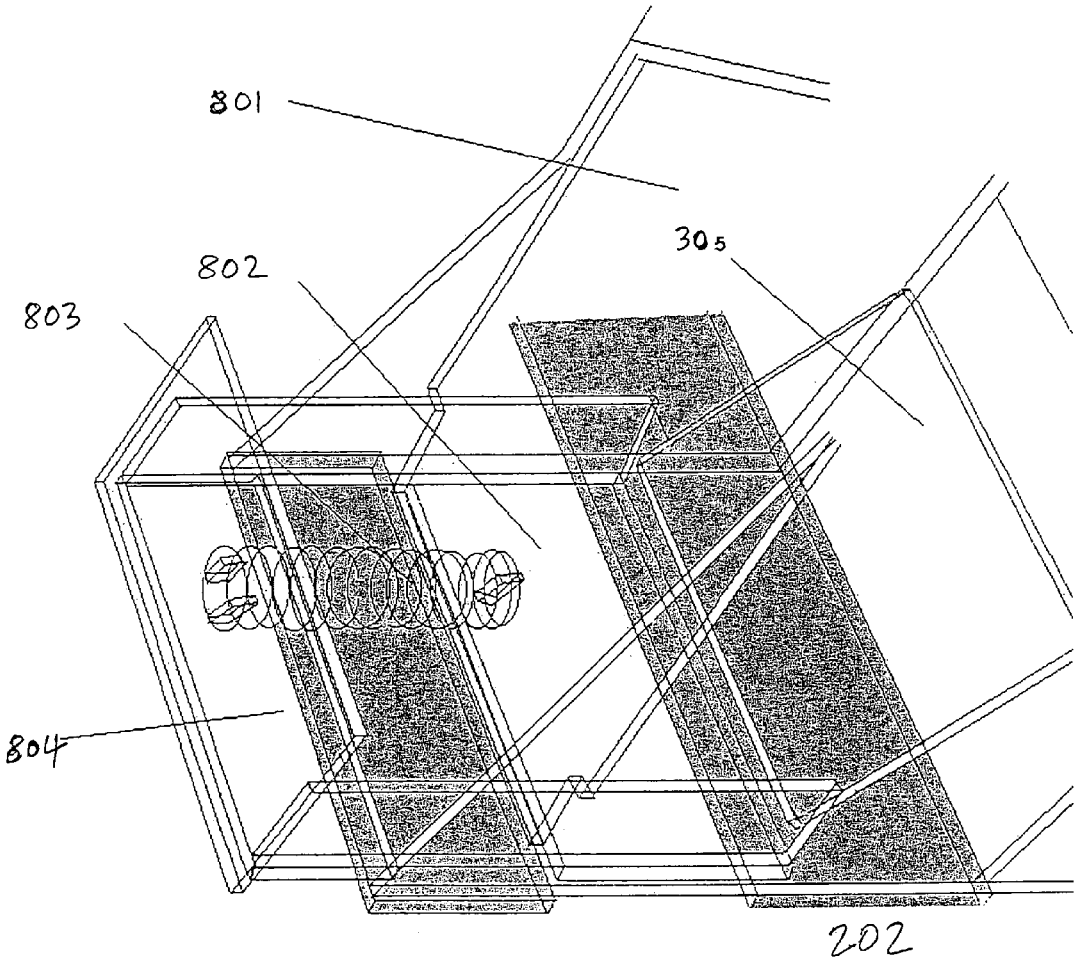
FIG. 8 is an enlarged view of a drawer compartment that is in the bottom row of the pill dispenser depicted in FIG. 6.

FIG. 8 is an enlarged view of the drawer compartments located in the bottom row of the pill dispenser 600. Drawer compartment 202 comprises bottom compartment wall 801, slide release 802, spring 803, push surface 804, and back slide ramp 305. The user can press on push surface 804 to "open" the drawer compartment and retrieve the pills stored inside. Spring 803 keeps push surface 804 in the "closed" position. Back slide ramp 305 facilitates falling pills from above to rest on bottom of the drawer compartment.

Figure 9:
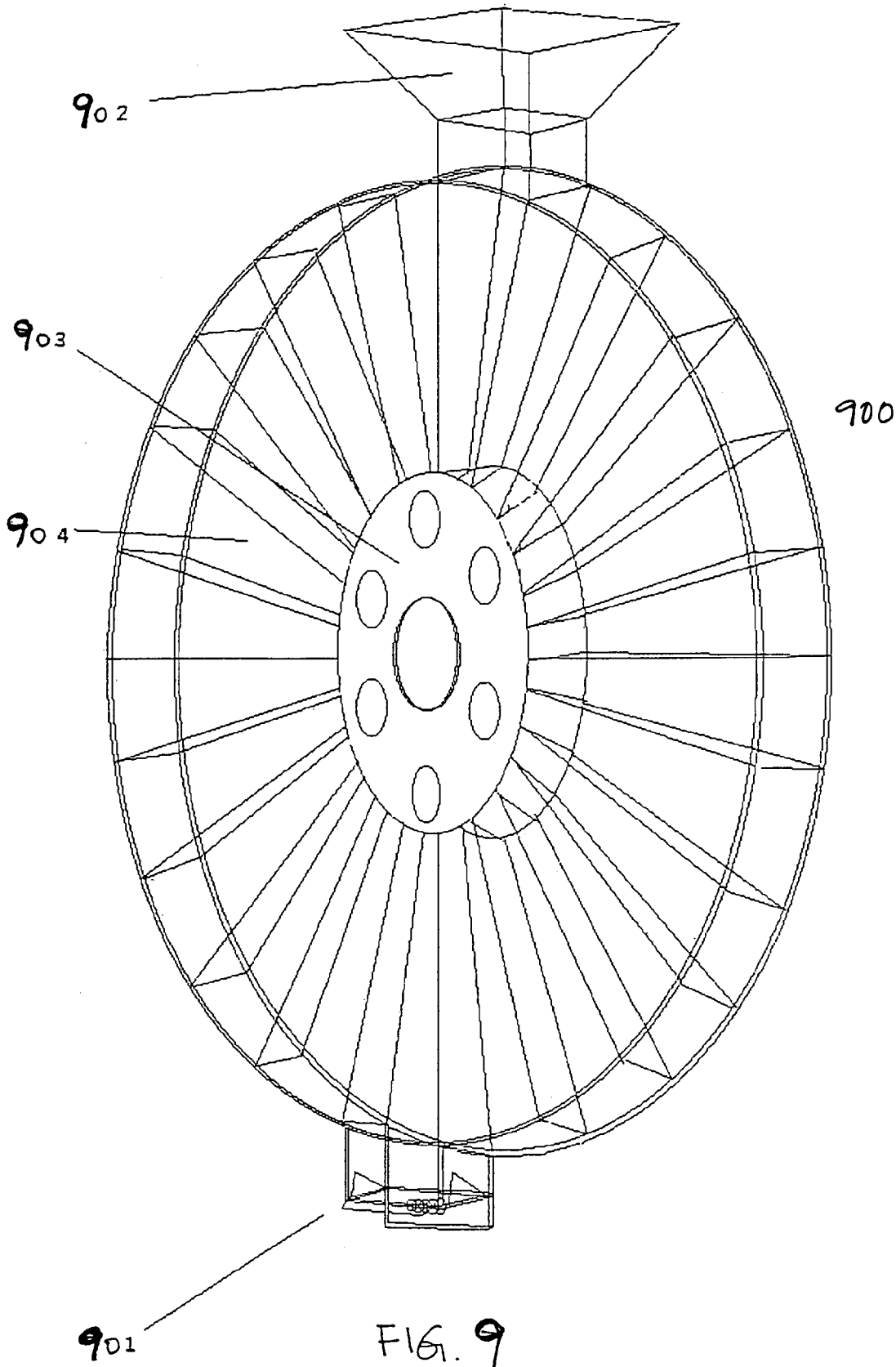
FIG. 9 shows another embodiment of the present invention.

FIG. 9 shows another embodiment of the present invention, a circular organizer. Circular organizer 900 comprises of trap door assembly 901, inlet funnel 902, rotating hub 903, and compartments 904. Circular organizer 900 is made of clear plastic or other see-through material, allowing the user to what pills are stored in each compartment. As shown in FIG. 9, compartments 904 extend radially from the center of rotating hub 903. Pills are deposited into the circular organizer through inlet funnel 902. Rotating hub 903 has a plurality of holes to allow to user to insert his or her fingers to rotate the circular organizer. The rotation allows for easy access to each compartment.

Figure 10:
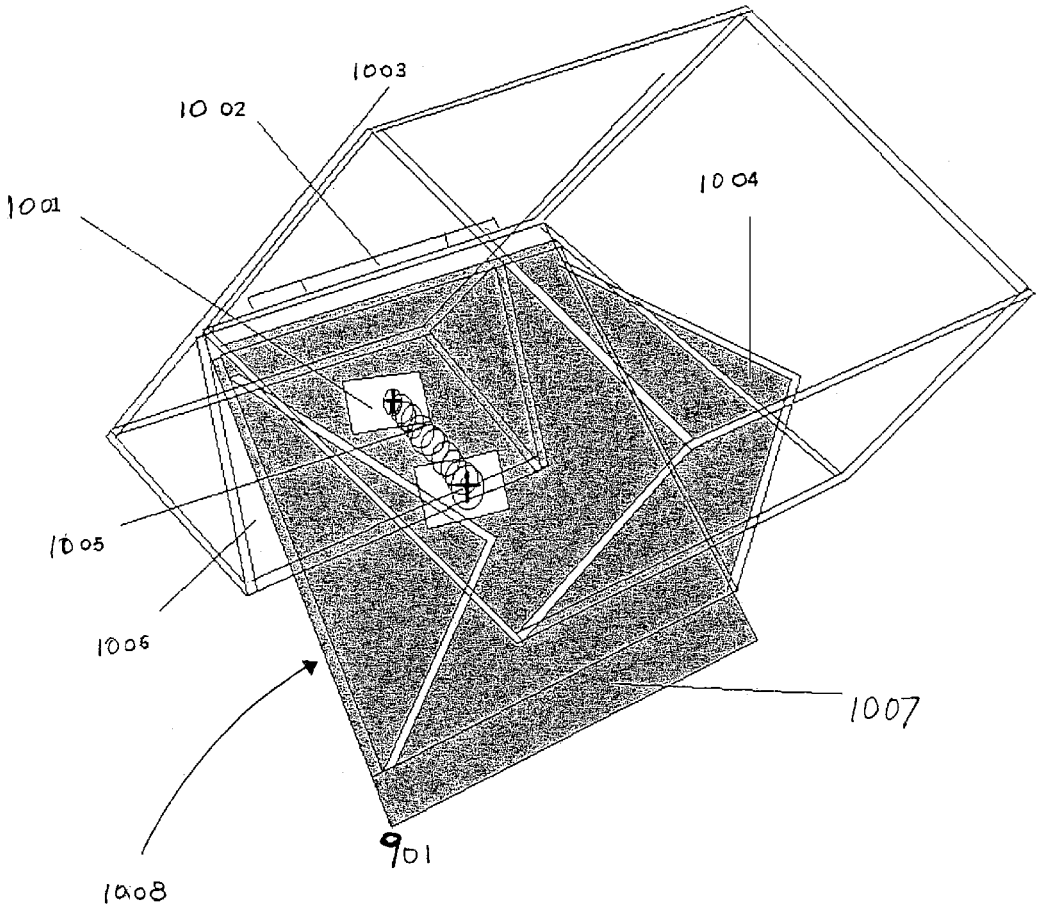
FIG. 10 is an enlarged view of a trap door assembly in the circular organizer depicted in FIG. 9, according to one embodiment of the present invention.

FIG. 10 is an enlarged perspective view of the interior components of trap door assembly 901 in one embodiment of the invention. Trap door assembly 901 comprises of trap door 1008 connected to the rest of the assembly via hinge 1002. Trap door 1008 is also connected to one end of spring mount 1001. Spring mount 1001 is connected on the other end to triangular spring box 1006, which is supported by reinforcing plate 1003. The spring is directed at an angle such that trap door 1008 is forced upward into a "closed" position by default. In the figure, reinforcing plate 1003, spring box 1006, and spring mount 1001 are all under the trap door 1008. At its "close" position, the trap door 1008 is flush with compartment 1004, allowing the compartments to be rotated without pills being dispensed.

Tab extension 1007 is provided at the end of trap door 1008 so that it can be moved into an "open" position (as shown in FIG. 10). By pushing downward on tab extension 1007, a user can pull down trap door 1008 and release any pill in the compartment immediately above the trap door assembly.

Although the pill dispensers and organizers of the present invention have been described in connection with the above embodiments, it is not intended to be limited to the specific form set forth herein, but on the contrary, it is intended to cover such alternatives, modifications, and equivalents, as can be reasonably included within the spirit and scope of the invention.

Thus, a pill dispenser and organizer is described in conjunction with one or more specific embodiments. The invention is defined by the following claims and their full scope of equivalents.

I claim:

1. A dispenser and organizer, comprising:

a lid attached to top of said dispenser and organizer;

a plurality of compartments organized in a plurality of rows and a plurality of columns to hold contents;

a mechanism for each of said compartments in a bottommost row of said dispenser and organizer to remove said contents;

a plurality of mechanisms on one vertical side, wherein each of said plurality of mechanisms is attached to each of said plurality of compartments in a column nearest to said vertical side except compartment in bottommost row.

2. The dispenser and organizer of claim 1 wherein said plurality of rows is 4.

3. The dispenser and organizer of claim 1 wherein said plurality of columns is 7.

4. The dispenser and organizer of claim 1 wherein said plurality of columns is 3.

5. The dispenser and organizer of claim 1 is made of clear plastic.

6. The dispenser and organizer of claim 1 wherein said lid is hinged to said top of said dispenser and organizer.

7. The dispenser and organizer of claim 1 wherein each of said plurality of mechanisms further comprises:

a push button attached to one end of a slide arm; and a spring coiled around said slide arm.

8. The dispenser and organizer of claim 7 wherein said spring is coiled around said slide arm inside said dispenser and organizer in which case said slide arm has to be pulled to release said contents from said compartment.

9. The dispenser and organizer of claim 7 wherein said spring is coiled around said slide arm outside said dispenser and organizer in which case said slide arm has to be pushed to release said contents from said compartment.

10. The dispenser and organizer of claim 1 wherein each of said plurality of mechanisms further comprises:

a slide button attached to top of a slide body; and a slot in which said slide button slides.

11. The dispenser and organizer of claim 1 wherein each of said compartments except said compartments in said bottommost row further comprises:

a pill rake attached to center of a bottom slide;

a slide body attached to said bottom slide of each of said plurality of compartments in a row;

a bottom slide; and a back slide attached at an angle to said bottom slide.

12. The dispenser and organizer of claim 1 wherein each of said compartments in said bottommost row further comprises:

a push button attached to a slide arm;

a spring coiled around said slide arm;

a slide body attached to bottom of said slide arm; and a back slide attached at an angle to a vertical side of said compartment.

13. The dispenser and organizer of claim 1 wherein each of said compartments in said bottommost row further comprises:

a push surface attached to a first end of a spring;

a slide release attached to a second end of said spring different from said first end; and a back slide attached at an angle to a vertical side of said compartment.

* * * * *